US005423732A

United States Patent [19]

Coe

[11] Patent Number: 5,423,732

[45] Date of Patent: Jun. 13, 1995

[54] METHOD OF PRODUCING SECURE EVENT TICKETS

[75] Inventor: Robert P. Coe, Grand Island, N.Y.

[73] Assignee: Moore Business Forms, Inc., Grand Island, N.Y.

[21] Appl. No.: 134,658

[22] Filed: Oct. 12, 1993

Related U.S. Application Data

[62] Division of Ser. No. 854,068, Mar. 19, 1992, Pat. No. 5,265,916.

[51] Int. Cl.[6] ..... B65H 35/04

[52] U.S. Cl. ..... 493/324; 101/227; 493/363

[58] Field of Search ..... 493/324, 325, 363, 369, 493/370, 371, 372; 83/332, 333, 663, 697; 101/224, 226, 227; 156/252, 264, 277

[56] References Cited

U.S. PATENT DOCUMENTS

| | | | |
|---|---|---|---|
| 2,708,873 | 5/1955 | Braun | 493/324 |
| 3,351,005 | 11/1967 | Giori | 101/226 |
| 3,750,538 | 8/1973 | Confer | 493/363 |
| 4,758,215 | 7/1988 | Kogane | 493/324 |

*Primary Examiner*—Jack W. Lavinder
*Attorney, Agent, or Firm*—Nixon & Vanderhye

[57] ABSTRACT

Tickets for concerts, conventions, sports, and like events, have a security feature to assist in preventing counterfeiting. A stretchable security thread is disposed in a piece of paper stock extending so that it intersects, with portions lying on either side of, a line of separation in the piece of paper stock (and/or is parallel to the length of the ticket). The line of separation typically is a perforation. The security thread is a stretchable material, such as polyester, and may have microprinting. When the ticket is detached at the line of separation, the security thread does not initially separate but rather stretches to provide a visual (and tactile) indication between the separated portions of the paper stock before it breaks. Such tickets are produced from a web of material having the security threads, which web is printed, and then cut into sheets for delivery to a customer who then can apply variable printing. If making perforations, care is taken not to make a perforation gap at the intersection of a security thread with a line of separation.

12 Claims, 1 Drawing Sheet

METHOD OF PRODUCING SECURE EVENT TICKETS

CROSS REFERENCE TO RELATED APPLICATION

This application is a divisional application of Ser. No. 07/854,068 filed Mar. 19, 1992, now U.S. Pat. No. 5,265,916.

BACKGROUND AND SUMMARY OF THE INVENTION

Counterfeiting of event tickets for concerts, galas, sporting events, and the like is common. There are a number of different techniques used in commerce today to attempt to thwart such counterfeiting. For example, for sporting events tickets are often printed on a paper stock that has a "slick" cast coated finish. Another commercially available product to attempt to thwart counterfeiting is the use of a laminated stock which has colored tissue laminated between two sheets of white paper. While these proposals can be successful, they usually require a ticket taker who is sharp, and they may produce final products which are undesirable for some situations.

According to the present invention, a method and product are provided which can simply, yet effectively, thwart counterfeiting of tickets and the like. The product according to the present invention is designed so that the anti-counterfeiting feature thereof becomes particularly visible to the ticket taker when the ticket taker is taking the action that requires his or her most concentration, proper separation of the ticket body from the ticket stub. The tickets are also produced in a simple manner, and while the paper stock from which the tickets are made is a special paper stock, it is relatively inexpensive, differing from conventional ticket paper stock only slightly (that is in the provision of a few security threads therein, typically only thread per ticket).

According to one aspect of the present invention, a piece of paper stock having a security feature therein is provided. The paper stock has first and second dimensions much greater than its thickness. Means are provided defining a line of separation (such as a line of weakness, like a perforation; or an indicia line) in the adhesive paper stock at which the stock is adapted to be torn or otherwise separated to separate the piece of paper stock into distinct pieces of stock. It also includes a stretchable security thread, such as a flat, preferably polyester thread that may have microprinting thereon, which extends so that it intersects, with portions lying on either side of, the line of separation. In this way when the piece of paper stock is separated along the line of separation the security thread does not initially separate but provides a visual and distinct resistance indication between the separated portions of the paper stock that it is there, stretching about one-quarter inch or so before it breaks.

The means defining a line of weakness are not essential, but rather the thread may merely be generally parallel to the dimension of elongation of a ticket formed from the stock.

The piece of paper stock preferably is a ticket for an event, having indicia printed on at least the top face thereof providing information relating to the event to which the ticket corresponds, or the agency using the same. The security thread provides a clear visual—and even tactile—indication to the ticket taker at the time that the ticket taker is concentrating most carefully (that is while separating the ticket stub from the body of the ticket). The security thread (which can be clear, metalized or colored), if present, makes it easy to see that the ticket is legitimate.

Normally the line of separation will be a line of weakness, such as a series of perforations. In such case, the perforating apparatus is constructed so that there is a significant gap at the security thread so that it is not severed by the perforating blade. However, the line of separation may merely be an indicia line instead of a line of weakness.

The invention comprises a method of producing a ticket for an event from a web of paper having edges, and stretchable security threads encased therewithin. The method comprises the following steps: (a) Providing the web of paper with security threads disposed therein so that the edges of the web are substantially parallel to the security threads, and so that the edges and threads are spaced from each other a predetermined distance in a first dimension. (b) Continuously printing the web to provide a plurality of printed tickets. (c) Cutting the web into sheets. And (d) providing means defining a line of separation in each individual printed ticket extending generally perpendicular to a security thread in that ticket, so that when a ticket is detached along the line of separation, the security thread is not initially detached but rather provides a visual indication between detached portions of the ticket on either side thereof that the security thread is present.

There also may be the further steps, after step (c) and prior to step (d), of: rotating the cut sheets 90°; gluing each cut sheet to a preceding sheet; punching line holes in the sheets for proper registration in the print device, right and left; and then folding the sheets for delivery. Steps (a)–(d) are typically practiced so as to provide each security thread in each printed ticket, although may multiple threads may be provided in each ticket if desired. Step (d) may be practiced by providing perforations at the line of separation, the perforations including perforation gaps, but no perforation gap being provided at the intersection of the security thread with the line of separation.

It is a primary object of the present invention to provide a ticket or the like that can thwart counterfeiting in a simple and inexpensive, yet effective, manner. This and other objects of the invention will become clear from an inspection of the detailed description of the invention, and from the appended claims.

DETAILED DESCRIPTION OF THE DRAWINGS

Figure 1:
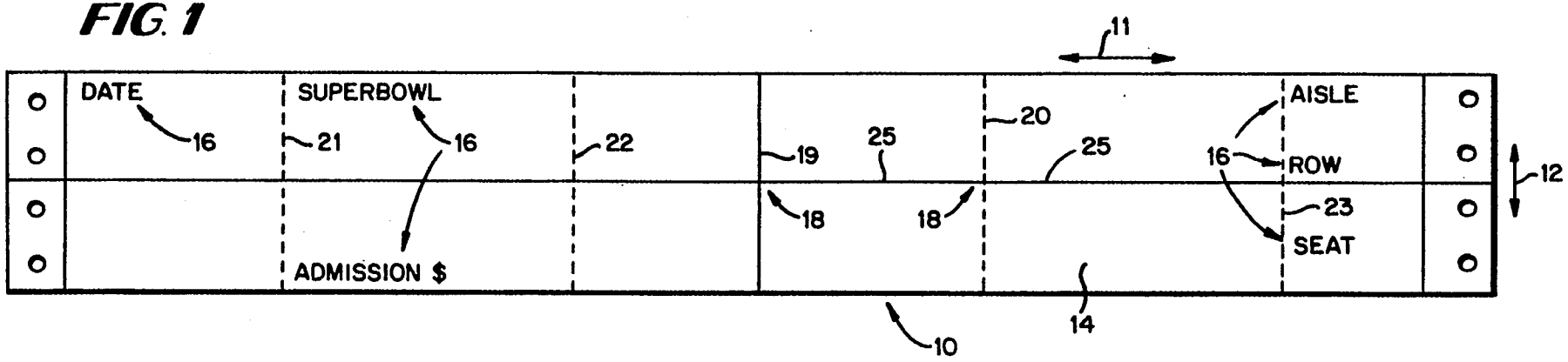
FIG. 1 is a top plan view of an exemplary ticket according to the present invention.
Figure 3:
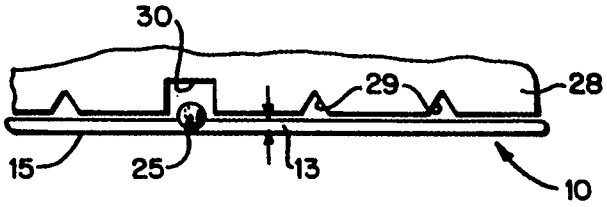
FIG. 3 is a side view schematically illustrating perforation of the paper stock adjacent a security thread to make the tickets of FIGS. 1 and 2.

A piece of paper stock 10, which is illustrated in the form of an event ticket (in this case a ticket for the Super Bowl) is illustrated in FIGURE 1. The term "paper stock" includes paper, paperboard, and all types of paperlike products that may be utilizable for event tickets or the like, such as ten point paper. The piece of paper stock 10 has length and width dimensions 11, 12, respectively, that are much greater than its thickness dimension 13 (see FIG. 3). It also includes a top face 14 (FIG. 1) and a bottom face 15 (see FIG. 3). Indicia 16 are printed on the top face 14 in order to provide an indication of what event the ticket relates to, perhaps an assigned seat that the ticket relates to, the admission price, date of the activity, etc. Of course, printing may also be provided on the bottom face 15 (such as conditions of liability, refund, etc.) if desired, as is conventional.

The piece of paper stock 10 also preferably includes means defining a line of separation therein at which the paper stock is adapted to be torn or otherwise separated to separate the piece of paper stock 10 into distinct pieces of stock, however, in some cases, the ticket is merely torn without a line to assist the tearing. A means defining a line of separation are shown generally by reference numeral 18, and may comprise an indicia line 19, or lines of weakness—typically perforations—20, 21, 22, and/or 23. The lines of separation 18 typically are perpendicular to the length dimension 11 and parallel to the width dimension 12, although depending upon the exact configuration of the paper stock/ticket 10 this could be different.

Figure 2:
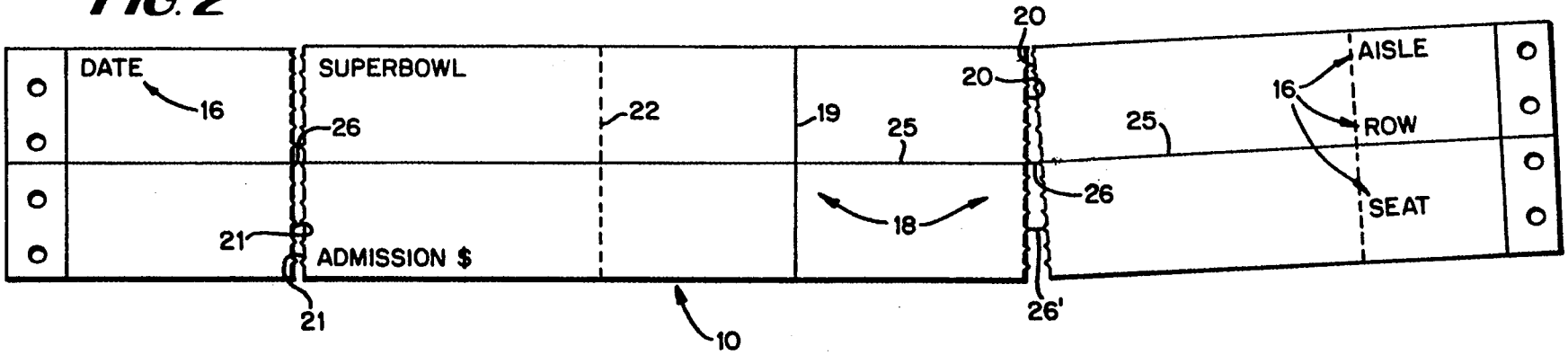
FIG. 2 is a top plan view of the ticket of FIG. 1 when separated along lines of separation thereof, showing the security thread providing a security feature.

What has been described above is conventional. What is new according to the present invention is the provision of a security thread 25 in the piece of paper stock 10. The security thread 25 extends —as illustrated in FIGS. 1 and 2—so that it is generally parallel to the dimension of elongation 11 of the ticket 10, e.g., so that it intersects, with portions lying on either side of, the lines of separation 18 (if provided). The security thread 25 is of a stretchable material, such as a flat polyester thread, and may be provided with microprinting thereon, such as described in British Patent 1,095,286. The paper, with security thread 25 therein, is per se commercially available from Portals, Inc. of Atlanta, Ga., and may be constructed according to said British Patent 1,095,286. Normally for use in making tickets just one security thread 25 is provided in each ticket (that is the security threads are spaced from each other about two inches in a web of paper supplied by Portals, Inc.), although multiple security threads per ticket may be provided if desired.

The effect of the stretchable security thread 25 disposed in the piece of paper stock 10 is to provide a visual and tactile indication to the ticket taker when he or she separates the stock 10 along a line of separation 18 (or along any line generally transverse to the dimension of elongation 11 of the ticket 10). For example, as illustrated in FIG. 2, if the ticket taker separates the portions of the stock 10 along the perforation lines 20, 21, the thread 25 stretches at those points of separation (typically stretching about ¼ inch before breaking), and is clearly visible between the distinct ticket portions, as illustrated at 26 in FIG. 2. Reference numeral 26' in FIG. 2 illustrates a second security thread visible portion, illustrating that multiple threads may be optionally provided in a single ticket 10.

If perforations, such as 20–23, are utilized in the construction of the ticket 10, it is, of course, necessary to form the perforations without severing the security thread (or threads) 25. For this purpose a perforating blade such as illustrated schematically at 28 in FIG. 3, may be utilized. The perforating blade includes normal notches 29 (at which point no perforation gap is formed), and at the area where the security thread 25 is provided (aligned), an enlarged notch 30 is provided to insure that the blade 28 does not severe the thread 25 when making perforation gaps; or a blade may be broken and moved apart at the thread location.

Tickets 10 may be mass produced according to a method of producing event tickets according to the invention. Tickets 10 are typically made from a conventional web of paper having edges, with stretchable parallel security threads encased within the paper, between the edges, again such paper being available from Portals, Inc. The spacing of the security threads 25 may be specified when ordering the paper from Portals, and for the particular purposes here would typically be about every two inches. In the practice of the method of the invention the following steps are followed: (a) Providing the web of paper with security threads 25 disposed therein so that the edges of the web are substantially parallel to the security threads, and so that the edges and threads are spaced from each other a predetermined distance in a first dimension (12). (b) Continuously litho printing the web to provide a plurality of printed tickets (10). (c) Cutting the web into sheets. And (d) providing means defining a line of separation (18) in each individual printed ticket (40) extending generally perpendicular to a security thread (25) in that ticket, so that when a ticket is detached along the line of separation, the security thread is not initially detached but rather provides a visual indication (26, 26') between detached portions of the ticket on either side thereof that the security thread is present.

The method may also comprise the further steps, after step (c) and prior to step (d) of: rotating the cut sheets 90 degrees; gluing each cut sheet to a preceding sheet; punching line holes (see the holes in FIGS. 1 and 2) in the sheets, right and left; and then folding the sheets for delivery. The main reason that the tickets would be rotated would be to provide more room to print, depending upon a particular customer's requirements. Some customers might prefer to the tickets to be printed in the long direction; while others would prefer them to be printed across the long direction, that is, 90° to the length (dimension 11) of the ticket. That is, the tickets (10) can be supplied in bulk to the customer, and the variable information (e.g., date, event) printed thereon after the sheets are delivered to the customer.

Steps (a)–(d) may be typically practiced to provide one security thread in each printed ticket 10, although more could be provided. Also, step (d) may be practiced prior to step (c), and typically is. There can be the subsequent variable information printing step after steps (a)–(d), and then and then a step of automatically (or manually) separating the sheets into individual tickets (10).

It will thus be seen that according to the present invention a product and method of manufacture thereof have been provided which assist in thwarting counterfeiting of event tickets and the like in a simple and relatively simple, inexpensive, yet effective manner. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. A method of producing a ticket for an event, from a web of paper having edges, and stretchable security threads encased therewithin, comprising the steps of:

(a) providing the web of paper with security threads disposed therein so that the edges of the web are substantially parallel to the security threads, and so that the edges and threads are spaced from each other a predetermined distance in a first dimension;

(b) continuously printing the web to provide a plurality of printed tickets;

(c) cutting the web into sheets; and (d) providing means defining a line of separation in each individual printed ticket extending generally perpendicular to a security thread in that ticket, so that when a ticket is detached along the line of separation, the security thread is not initially detached but rather provides a visual indication between detached portions of the ticket on either side thereof that the security thread is present.

2. A method as recited in claim 1 wherein said steps (a)-(d) are practiced so as to provide one security thread in each printed ticket.

3. A method as recited in claim 1 wherein step (d) is practiced by providing perforations at the line of separation, the perforations including perforation gaps, but no perforation gap being provided at the intersection of a security thread with the line of separation.

4. A method as recited in claim 3 wherein step (d) is practiced prior to step (c).

5. A method as recited in claim 3 comprising the further steps of (e) printing variable information on the sheets after steps (a)-(d); and then (f) separating the sheets into individual tickets.

6. A method as recited in claim 3 wherein said steps (a)-(d) are practiced so as to provide one security thread in each printed ticket.

7. A method as recited in claim 1 wherein step (e) is practiced prior to step (c).

8. A method as recited in claim 7 comprising the further steps of (e) printing variable information on the sheds after steps (a)-(d); and then (f) separating the sheets into individual tickets.

9. A method as recited in claim 7 wherein said steps (a)-(d) are practiced so as to provide one security thread in each printed ticket.

10. A method as recited in claim 1 comprising the further steps of (e) printing variable information on the sheets after steps (a)-(d); and then (f) separating the sheets into individual tickets.

11. A method as recited in claim 10 wherein said steps (a)-(d) are practiced so as to provide one security thread in each printed ticket.

12. A method of recited in claim 1 wherein steps (a) through (d) are practiced so as to provide a plurality of security threads in each printed ticket.

* * * * *